US006981672B2

(12) United States Patent
Clancy et al.

(10) Patent No.: US 6,981,672 B2
(45) Date of Patent: Jan. 3, 2006

(54) FIXED CANARD 2-D GUIDANCE OF ARTILLERY PROJECTILES

(75) Inventors: John A. Clancy, Eden Prairie, MN (US); Thomas D. Bybee, Ramsey, MN (US); William A. Friedrich, Minnetonka, MN (US)

(73) Assignee: Aleiant Techsystems Inc., Edina, MN (US)

( * ) Notice: Subject to any disclaimer, the term of this patent is extended or adjusted under 35 U.S.C. 154(b) by 0 days.

(21) Appl. No.: 10/664,223

(22) Filed: Sep. 17, 2003

(65) Prior Publication Data

US 2005/0056723 A1 Mar. 17, 2005

(51) Int. Cl.
*F42B 10/02* (2006.01)
*F41G 7/00* (2006.01)
*F41G 9/00* (2006.01)

(52) U.S. Cl. ..... 244/3.24; 244/3.1; 244/3.23
(58) Field of Classification Search ..... 244/3.1–3.3
See application file for complete search history.

(56) References Cited

U.S. PATENT DOCUMENTS

| | | | | |
|---|---|---|---|---|
| 3,262,655 A | * | 7/1966 | Gillespie, Jr. | 244/3.21 |
| 4,211,378 A | | 7/1980 | Crepin | |
| 4,399,962 A | | 8/1983 | Wedertz et al. | |
| 4,438,893 A | | 3/1984 | Sands et al. | |
| 4,512,537 A | | 4/1985 | Sebestyen et al. | |
| 4,552,071 A | | 11/1985 | Horais et al. | |
| 4,568,039 A | | 2/1986 | Smith et al. | |
| 4,592,525 A | * | 6/1986 | Madderra et al. | 244/3.28 |
| 4,941,627 A | | 7/1990 | Moscrip | |
| 5,085,380 A | | 2/1992 | Barton | |
| 5,139,216 A | * | 8/1992 | Larkin | 244/3.21 |
| 5,143,320 A | | 9/1992 | Boyadjian | |
| 5,164,538 A | * | 11/1992 | McClain, III | 244/3.23 |
| 5,425,514 A | | 6/1995 | Grosser | |
| 5,452,864 A | | 9/1995 | Alford et al. | 244/3.23 |
| 6,360,987 B1 | * | 3/2002 | Sallaee et al. | 244/3.21 |
| 6,378,801 B1 | * | 4/2002 | Pell et al. | 244/3.24 |
| 6,402,087 B1 | | 6/2002 | Farina et al. | 244/3.21 |
| 6,502,786 B2 | | 1/2003 | Rupert et al. | 244/3.27 |

* cited by examiner

*Primary Examiner*—Bernarr E. Gregory
(74) *Attorney, Agent, or Firm*—Vidas, Arrett & Steinkraus, P.A.

(57) ABSTRACT

Applicants have invented a guidance system for guiding a projectile, the projectile having a body portion capable of being spun in a first direction and a nose portion connected to the body portion by a spin control coupling, the nose portion being capable of being spun in a second direction. The nose portion including first and second aerodynamic surfaces fixedly attached to the nose portion and configured and arranged to cause the nose portion to spin in a second direction during projectile flight. The nose portion including third and fourth aerodynamic surfaces fixedly attached to the nose portion, which are configured and arranged such that when the nose portion is spinning the third and fourth aerodynamic surfaces have no net effect on projectile flight, but when the nose portion is despun using the spin control coupling, the third and fourth aerodynamic surfaces induce both a moment and a lateral force to the nose, causing the projectile flight path to change.

13 Claims, 3 Drawing Sheets

Alliant Techsystems Proprietary

Figure 1 – Front View

Spin Canards = 4° Cant
Steering Canards = 4° Cant

Alliant Techsystems Proprietary

Figure 2 – Side View

Alliant Techsystems Proprietary

Figure 3 – Cross-Section View

Alliant Techsystems Proprietary

FIXED CANARD 2-D GUIDANCE OF ARTILLERY PROJECTILES

CROSS-REFERENCE TO RELATED APPLICATIONS

Not Applicable

STATEMENT REGARDING FEDERALLY SPONSORED RESEARCH

Not Applicable

BACKGROUND OF THE INVENTION

This invention relates generally to a guidance system and more particularly to a guidance system for an artillery projectile.

Delivery errors are known to significantly degrade the effectiveness of artillery projectiles. Adding guidance capability to the fuze mounted at the nose of the projectile is highly desirable because it can be used to retrofit legacy hardware. However, the packaging volume is very limited.

Prior guidance systems utilizing canards have been proposed. See for example the following patents:

U.S. Pat. No. 4,373,688;

U.S. Pat. No. 4,438,893;

U.S. Pat. No. 4,512,537;

U.S. Pat. No. 4,568,039;

U.S. Pat. No. 5,425,514, and

U.S. Pat. No. 6,502,786.

However, many of the prior systems utilize canard actuators, which require substantial volume and/or the designs have significantly added to the cost of the fuze.

What is needed is a simple guidance system which fits within the existing package volume and which is relatively inexpensive compared to prior guidance systems for artillery projectiles.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

All US patents and applications and all other published documents mentioned anywhere in this application are incorporated herein by reference in their entirety.

BRIEF SUMMARY OF THE INVENTION

Applicants have invented a guidance system for guiding a projectile, the projectile having a body portion capable of being spun in a first direction and a nose portion connected to the body portion by a spin control coupling, the nose portion being capable of being spun in a second direction. The nose portion including first and second aerodynamic surfaces fixedly attached to the nose portion and configured and arranged to cause the nose portion to spin in a second direction during projectile flight. The nose portion including third and fourth aerodynamic surfaces fixedly attached to the nose portion, which are configured and arranged such that when the nose portion is spinning the third and fourth aerodynamic surfaces have no net effect on projectile flight, but when the nose portion is despun using the spin control coupling, the third and fourth aerodynamic surfaces induce both a moment and a lateral force to the nose, causing the projectile flight path to change.

In a preferred embodiment of the invention the aerodynamic surfaces are arranged in two pairs, a pair of spin canards and a pair of steering canards. The spin canards are mounted 180° apart on the nose portion of the projectile, in the 0° and 180° positions, and the steering canards are mounted 180° apart on the nose portion of the projectile, in the 90° and 270° positions.

In a preferred embodiment the spin canards are differentially canted, one in the first direction and the other in the second direction. In the preferred embodiment each spin canard is differentially canted 4°, although the spin canards could be canted at any desired angle, and each at a different angle, if desired, so long as the spin canards enabled the despun nose section to respin.

In a preferred embodiment the steering canards each have a 4° cant angle, although the steering canards could be canted at any desired angle, and each at a different angle, so long as the steering canards enabled the steering of the projectile.

The projectile further includes a navigation system which is connected to the spin control coupling, the navigation system using the spin control coupling to despin the nose portion to make a course correction, then using the spin control coupling to allow the nose portion to freely rotate, whereupon the first and second canards cause the nose portion to respin in the second direction.

These and other embodiments which characterize the invention are pointed out with particularity in the claims annexed hereto and forming a part hereof. However, for a better understanding of the invention, its advantages and objectives obtained by its use, reference should be made to the drawings which form a further part hereof and the accompanying descriptive matter, in which there is illustrated and described a embodiments of the invention.

BRIEF DESCRIPTION OF THE SEVERAL VIEWS OF THE DRAWING(S)

A detailed description of the invention is hereafter described with specific reference being made to the drawings.

DETAILED DESCRIPTION OF THE INVENTION

Figure 1:
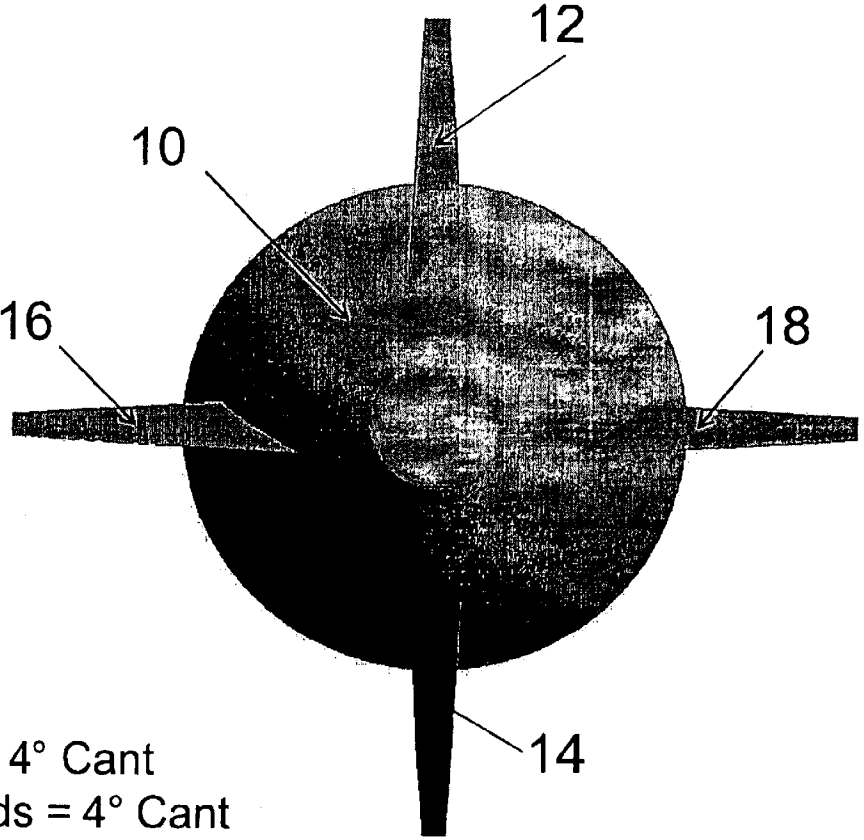
FIG. 1 is a front view of the nose portion of the projectile.

While this invention may be embodied in many different forms, there are described in detail herein specific preferred embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

The inventive 2-Dimensional (2-D) guidance system is designed for use on spin-stabilized projectiles that spin at high rates (150 to 300 Hz) and on rolling airframe tail-fin stabilized projectiles that spin at much lower rates (2 to 50

Hz). The 2-D guidance system provides a maneuver capability to adjust the final impact point in both range and deflection and, for conventional projectiles, is installed in place of a standard nose fuze. The 2-D guidance system has a standard threaded interface to allow it to be screwed into the projectile fuze well.

Figure 2:
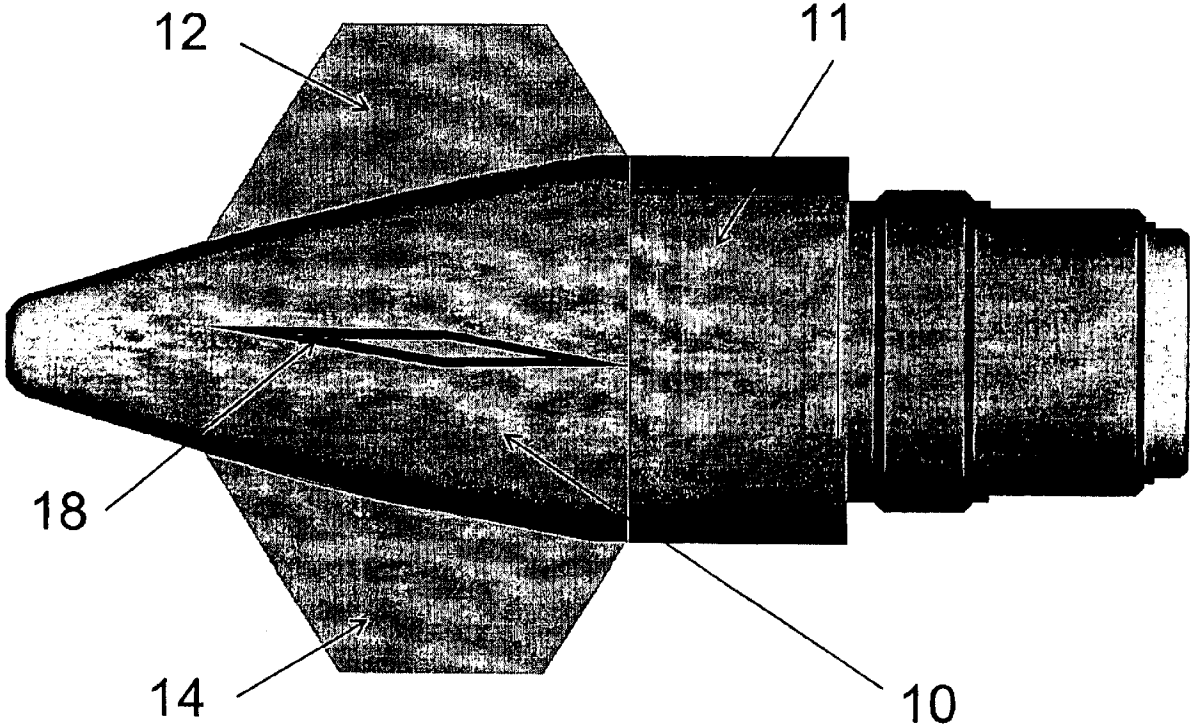
FIG. 2 is a side view of the nose portion of the projectile.

Referring now to FIGS. 1 and 2, the 2-D guidance system consists of two sections, which are the nose assembly 10 and the fuze sleeve 11 (best seen in FIG. 2). The fuze sleeve and nose assembly are connected by a set of bearings, forward bearing 13 and rear bearing 15 (best seen in FIG. 3) that allows the two sections 10 and 11 to rotate independently. The fuze sleeve 11, threaded into the standard fuze well, is physically connected to the projectile. This causes the fuze sleeve 11 to rotate in the same direction and with the same spin rate as the spin-stabilized projectile after it is fired from a rifled-barrel cannon or a tail-fin stabilized projectile after launch from a rifled-barrel or smoothbore cannon. Attached to the nose assembly 10 is a set of fixed aerodynamic surfaces. In one implementation, these surfaces are four small canards or fins that are connected to the nose assembly at fixed cant angles and located 90 degrees apart around the circumference of the nose assembly. The canards are arranged in pairs to perform separate and distinct functions. The first pair, the spin canards 12 and 14, are located in the 0 and 180 degree positions. The spin canards 12 and 14 are differentially canted in a manner to create a torque of sufficient magnitude to overcome the friction of the bearings and cause the nose assembly to rotate in a direction opposite of the projectile spin. This is due to aerodynamic forces on the canards created by the air stream as the projectile flies through the atmosphere. The canard size and cant angle are designed to ensure counter-rotation through-out the entire flight regime for all expected launch velocities, launch angles, and atmospheric conditions when the nose assembly is allowed to rotate freely. Although the cant angle can be any desired angle, including each being at a different angle, in one embodiment canard 12 is canted 4° counterclockwise and canard 14 is canted 4° clockwise.

The second pair of canards, the steering canards 16 and 18 are located in the 270 and 90 degree positions, are the steering canards and are canted in the same direction so that they create lift. Again, although the cant angle can be any desired angle, including each being at a different angle, in one embodiment both canards 16 and 18 are canted at a 4° angle. For steering, the nose assembly is de-spun and held inertially stable in a desired roll position to allow the lift generated by the steering canards to impart a force on the nose of the projectile. This creates an angle-of-attack and a subsequent change in the flight path. In a bank-to-turn approach, steering is accomplished by stabilizing the nose assembly at the appropriate roll angle to create lift in a desired direction. The canard size and cant angle are designed to provide the desire maneuver or control authority. As a complete set, the canard size and cant angles are also designed to minimize additional drag and any associated loss in range.

Figure 3:
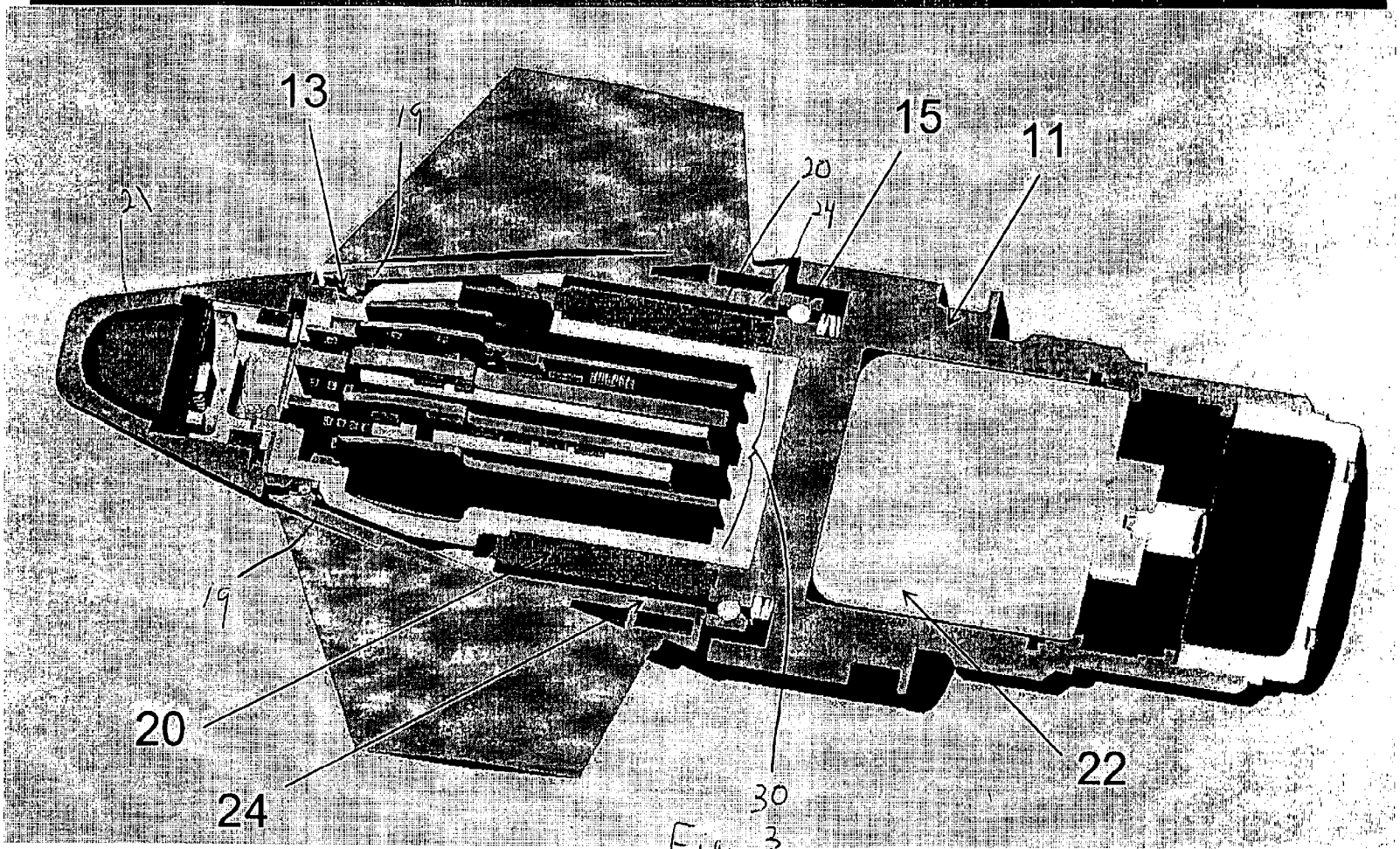
FIG. 3 is a cross-section view of the projectile.

Referring now to FIG. 3, it can be seen that the nose assembly 10 includes a nose skin section 19 to which all four canards 12, 14, 16 and 18 are attached. Forward bearings 13 and rear bearings 15 allow section 19, the portion of the nose assembly containing all four canards to despin and respin relative to the fuze sleeve section 11, the internal electronics assembly 30 and the radome 21 of the nose assembly. The fuze sleeve section 11, radome 21 and the electronics inside the nose assembly (discussed more fully below) rotate with the projectile body while the nose section 19 portion of the nose assembly spin oppositely to the projectile body and can be despun and respun.

Another important feature of this system is the method used to de-spin the nose section 19. Because of the counter-rotation, all that is required to de-spin the nose section 19 is a means to reduce its rotation rate until it is stabilized in the desired roll attitude. This de-spin function is provided by an alternator and variable-resistance load system 22. The alternator consists of an armature 20 and a set of fixed magnets 24. The armature 20 is mounted to the fuze sleeve 11 so that it rotates with the projectile body, along with the radome 21 and fuze sleeve 11, while the magnets 24 are mounted to the nose section 19, which spins oppositely to the projectile body. As the armature 20 and fixed magnets 24 rotate relative to each other the alternator generates a voltage and a current output that is applied to the variable-resistance load system 22. The current flowing in the armature windings 20 creates an electromotive force that generates a torque that resists the torque from the spin canards 12 and 14. The variable-resistance load system 22 can be adjusted to cause an increase or decrease in the current flowing through armature windings 20 and therefore an increase or decrease in the opposing torque. Less resistance in the load 22 causes more current flow and more opposing torque so the spin rate of the nose section 19 is reduced. Increasing the resistance causes less current flow and therefore less opposing torque so the spin rate of the nose section 19 will increase. The variable load 22 is continuously adjusted in real-time by the 2-D guidance system to de-spin the nose section 19 and stabilize the steering canards 16 and 18 in the proper roll attitude to achieve a desired maneuver.

The nose assembly 10 also includes electronics 30 in the form of a plurality of circuit cards, two of which make up the GPS receiver, as is well known in the prior art. The electronics 30 also includes a circuit card(s) which make up the Height of Burst RF Proximity Sensor (RF HOB), which is also well known in the prior art. The electronics 30 also includes an onboard computer. The electronics 30 also includes the 2-D guidance system, where the GPS receiver provides a navigation function that provides real-time updates of the projectile position and velocity. However, a combined GPS/INS system or any other combination of navigation sensors capable of providing the required navigation accuracy could also be used, all of which are well known in the art. With an on-board navigation capability the desired target location or point of impact is loaded into the 2-D guidance system prior to launch (or after launch if an uplink channel is provided) and the on-board computer generates steering commands to adjust the flight path of the projectile in a manner to minimize the impact location error relative to the preprogrammed target location. In another possible implementation the steering commands could be generated by an on-board seeker system that locates and selects a target that could be stationary or moving. Steering commands could also be provided to the 2-D guidance system via an uplink from a ground or airborne tracking system that could monitor the trajectory of the projectile. In real-time the tracking system would predict the impact errors, determine the required adjustments, and send commands to the 2-D guidance system to correct the flight path.

The nose assembly 10 contains a faze and navigation system, both of which are well known in the art. The nose assembly 10 is designed to screw onto a legacy projectile so that older artillery projectiles can be retrofitted with the improved 2-D fixed canard guidance system.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A projectile guidance system comprising:

a body portion;

a nose portion connected to the body portion by a spin control coupling;

said spin control coupling being constructed and arranged so that when the body portion is spinning in a first rotational direction, the nose portion will spin in a second rotational direction;

the nose portion including first and second aerodynamic surfaces fixedly attached to the nose portion and configured and arranged to cause the nose portion to spin in the second rotational direction during projectile flight;

the nose portion including third and fourth aerodynamic surfaces fixedly attached to the nose portion and being configured and arranged such that when nose portion is spinning the third and fourth aerodynamic surfaces have no net effect on projectile flight, but when the nose portion is despun using the spin control coupling, the third and fourth aerodynamic surfaces induce both a moment and a lateral force to the nose, causing the projectile flight path to change.

2. The projectile guidance system 1 wherein the first and second aerodynamic surfaces are spin canards mounted on opposite sides of the nose portion.

3. The projectile guidance system of claim 2 wherein the first and second spin canards are differentially canted.

4. The projectile guidance system of claim 3 wherein the first and second spin canards are each differentially canted at the same angle.

5. The projectile guidance system of claim 4 wherein the first and second spin canards are each differentially canted at 4°.

6. The projectile guidance system of claim 3 wherein the first and second spin canards are each differentially canted at a different angle.

7. The projectile guidance system of claim 1 wherein the third and fourth aerodynamic surfaces are steering canards mounted on opposite sides of the nose portion.

8. The projectile guidance system of claim 7 wherein the steering canards are each canted at the same angle.

9. The projectile guidance system of claim 8 wherein the steering canards each have a 4°cant angle.

10. The projectile guidance system of claim 7 wherein the steering canards each canted at a different angle.

11. The projectile guidance system of claim 10 wherein the cant angle of each steering canard is different than the cant angle of each spin canard.

12. The projectile guidance system of claim 1 further including a navigation system which is connected to the spin control coupling, the navigation system using the spin control coupling to despin the nose portion to make a course correction, then using the spin control coupling to allow the nose portion to freely rotate, whereupon the first and second aerodynamic surfaces cause the nose portion to respin in the second direction.

13. A projectile guidance system comprising:

a body portion;

a nose portion connected to the body portion by a spin control coupling, the spin control coupling constructed and arranged so that when the projectile is in flight the body portion spins in a first rotational direction and the nose portion spins in the opposite rotational direction;

the nose portion including first and second aerodynamic surfaces fixedly attached to the nose portion and configured and arranged to cause the nose portion to spin in the opposite rotational direction during projectile flight;

the nose portion including third and fourth aerodynamic surfaces fixedly attached to the nose portion, which are configured and arranged such that when the nose portion is spinning the third and fourth aerodynamic surfaces have no net effect on projectile flight but when the nose portion is despun using the spin control coupling the third and fourth aerodynamic surfaces induce both a moment and a lateral force to the nose portion causing the projectile flight path to change.

* * * * *

UNITED STATES PATENT AND TRADEMARK OFFICE

CERTIFICATE OF CORRECTION

PATENT NO. : 6,981,672 B2
DATED : January 3, 2006
INVENTOR(S) : Clancy, Bybee and Friedrich It is certified that error appears in the above-identified patent and that said Letters Patent is hereby corrected as shown below:

Title page,
Item [73], Assignee, delete "Aleiant" and insert -- Alliant --.

Signed and Sealed this

Seventh Day of March, 2006

JON W. DUDAS
*Director of the United States Patent and Trademark Office*